United States Patent [19]

Perry

[11] 4,227,179

[45] Oct. 7, 1980

[54] ARRANGEMENT FOR CONTROL OF REMOTE EQUIPMENT

[75] Inventor: Fred G. Perry, Lynchburg, Va.

[73] Assignee: General Electric Company, N.Y.

[21] Appl. No.: 16,885

[22] Filed: Mar. 2, 1979

[51] Int. Cl.[2] ..... H04Q 7/00

[52] U.S. Cl. ..... 340/147 LP; 455/58

[58] Field of Search ..... 340/147 LP; 325/21, 325/56, 304

[56] References Cited

U.S. PATENT DOCUMENTS

| | | | |
|---|---|---|---|
| 3,906,445 | 9/1975 | Beckmann | 325/57 |
| 4,013,959 | 3/1977 | Patterson | 340/147 LP |
| 4,035,729 | 7/1977 | Perry | 325/56 |
| 4,105,974 | 8/1978 | Rogers | 325/21 |

*Primary Examiner*—Harold I. Pitts
*Attorney, Agent, or Firm*—James J. Williams

[57] ABSTRACT

Remote equipment is controlled from each of several control locations by means of an arrangement which prevents more than one control location from producing a control signal at the same time and which provides a delay between control signals for proper resetting of the controlled equipment. The response of the arrangement is optimum in that the effective delay is never greater than the minimum required for proper control of the remote equipment. The control locations may also be provided with logic circuits connected together so that each control location has the desired priority of control with respect to the other control locations.

7 Claims, 3 Drawing Figures

ARRANGEMENT FOR CONTROL OF REMOTE EQUIPMENT

BACKGROUND OF THE INVENTION

My invention relates to an arrangement for the control of remote equipment, and particularly to such an arrangement that permits a plurality of different locations to control the remote equipment.

Remote equipment is frequently operated by a control location which produces a signal or tone or tone sequence indicative of the desired control function. In previous systems having several control locations, one or more control locations may produce a control signal at the same time another control location produces a control signal. These simultaneous control signals may interfere with each other and cause the remote equipment to perform an undesired function, or to perform no function at all.

Accordingly, a general object of my invention is to provide a new and improved arrangement for the remote control of equipment.

Another object of my invention is to provide a new and improved arrangement for controlling equipment from a plurality of different locations without interference.

Another object of my invention is to provide a new and improved arrangement for controlling equipment from a plurality of control locations by permitting only one of the control locations to produce a control signal at one time.

Another object of my invention is to provide a new and improved arrangement for controlling remote equipment from a plurality of control locations by providing, at each control location, an arrangement that prevents each control location from producing a control signal if a control signal is being produced by any other control location.

In a control arrangement as described, it is desirable that after the control signal from one control location terminates, sufficient time elapse before another control signal is produced to give the controlled equipment time to reset or return to a normal condition. This is particularly true where the control signal may be in the form of a tone requiring the controlled equipment to use filters which take time to return to a normal condition.

Accordingly, another object of my invention is to provide a new and improved arrangement that prevents a control location from producing a control signal for controlling equipment until any existing control signal has ended and a predetermined delay time has elapsed so as to permit the controlled equipment to reset or return to a normal condition.

In many systems it is important to minimize the response time of the controlled equipment to the controlling signal. This conflicts with the requirement that the time between control signals be sufficient for the controlled device to reset. In a rapid sequence of control actions, the minimum interval between control signals must be at least as large as the time required for the controlled device to reset. However, as control actions become farther apart in time the need for delay diminishes. When the time between control actions exceed the reset time, no delay is needed.

Accordingly, another object of my invention is to provide a new and improved arrangement that optimizes response time by introducing a delay whose effective length is the minimum amount required to insure proper response action of the controlled device.

In a control arrangement as described, it may also be desirable that a priority of controls be established between the control locations so that a higher priority control location can interrupt or override a lower priority control location.

Accordingly, another object of my invention is to provide a new and improved arrangement for providing priority of control between a plurality of control locations connected to controlled equipment.

SUMMARY OF THE INVENTION

Briefly, these and other objects are achieved in accordance with my invention by providing, at each control location, a control signal detector for sensing the presence of a control signal being sent to the controlled equipment, a delay circuit with fast attack and slow release characteristics, a control signal generator for producing a control signal, and operating means for the signal generator. A logic circuit interconnects the signal detector, the delay circuit, the signal generator, and the operating means so that the signal generator is not activated by the operating means until after the signal detector indicates no control signal from other control locations, and the slow release has operated. In addition, control locations may be provided with a circuit for connection to other control locations for establishing priority of control between the control locations.

BRIEF DESCRIPTION OF THE DRAWING

The subject matter which I regard as my invention is particularly pointed out and distinctly claimed in the claims. The structure and operation of my invention, together with further objects and advantages, may be better understood from the following description given in connection with the accompanying drawing, in which:

DESCRIPTION OF THE PREFERRED EMBODIMENT

Figure 1:
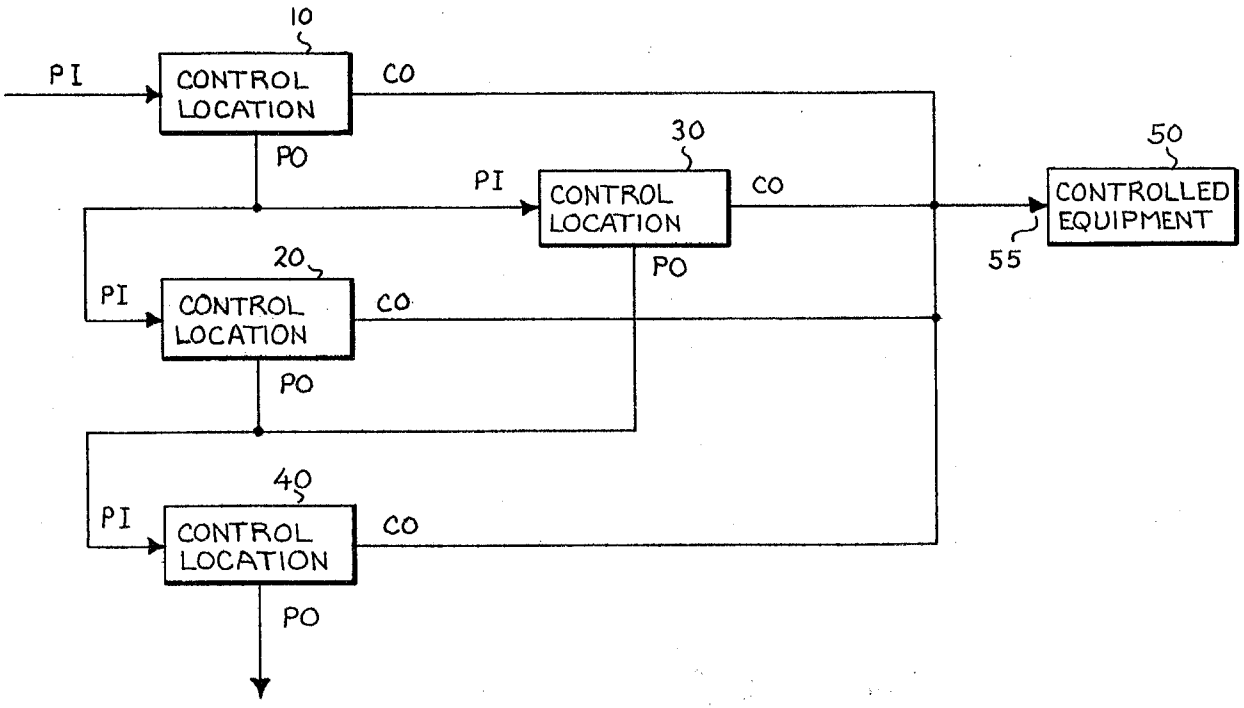
FIG. 1 shows a block diagram of a remote control system for which my invention is intended.

In FIG. 1, I have assumed that common controlled equipment 50, which may be a radio transmitter for example, is remotely controlled by a plurality of four control locations 10, 20, 30, 40. Depending upon actual circumstances, the distance between the control locations 10, 20, 30, 40 and the controlled equipment 50 may be a few feet or many miles. Each of the locations 10, 20, 30, 40 has a priority input PI, a priority output PO, and a control output CO. As an example, I have also assumed that the location 10 has first priority of control; locations 20, 30 have second and equal priority of control; and location 40 has third priority of control. It is to be understood that almost any number of control locations can be connected in any priority arrangement desired. For the assumed example, the priority input PI of location 10 is unconnected; the priority output PO of location 10 is connected to the priority inputs PI of locations 20, 30; and the priority outputs PO of locations 20, 30 are connected to the priority input PI of location 40. The control outputs CO of locations 10, 20, 30, 40 are connected to a common control input 55 of the equipment 50. In the example of a radio transmitter mentioned above, each of the control locations 10, 20, 30, 40 may be in an office having a microphone and amplifier connected over a telephone circuit to the input 55 so that an operator at each of the control locations 10, 20, 30, 40 may key or turn on the transmitter to send a message. Each operator may also have to perform other control functions, such as changing the frequency of the transmitter. These control functions may be provided in several ways, for example tones whose particular frequency indicates a particular function, or pulses (either tone or direct current) whose particular format indicates a particular function. In either case, it is desirable, and sometimes essential, that only one control location be permitted to send control signals or tones at any one time. If two or more of the control locations 10, 20, 30, 40 were to send control signals at the same time, the controlled equipment 50 may not perform any function, or may perform an incorrect function. My invention provides an arrangement for insuring that only one control location of a plurality of such locations is permitted to send a control signal at any one time.

Figure 2:
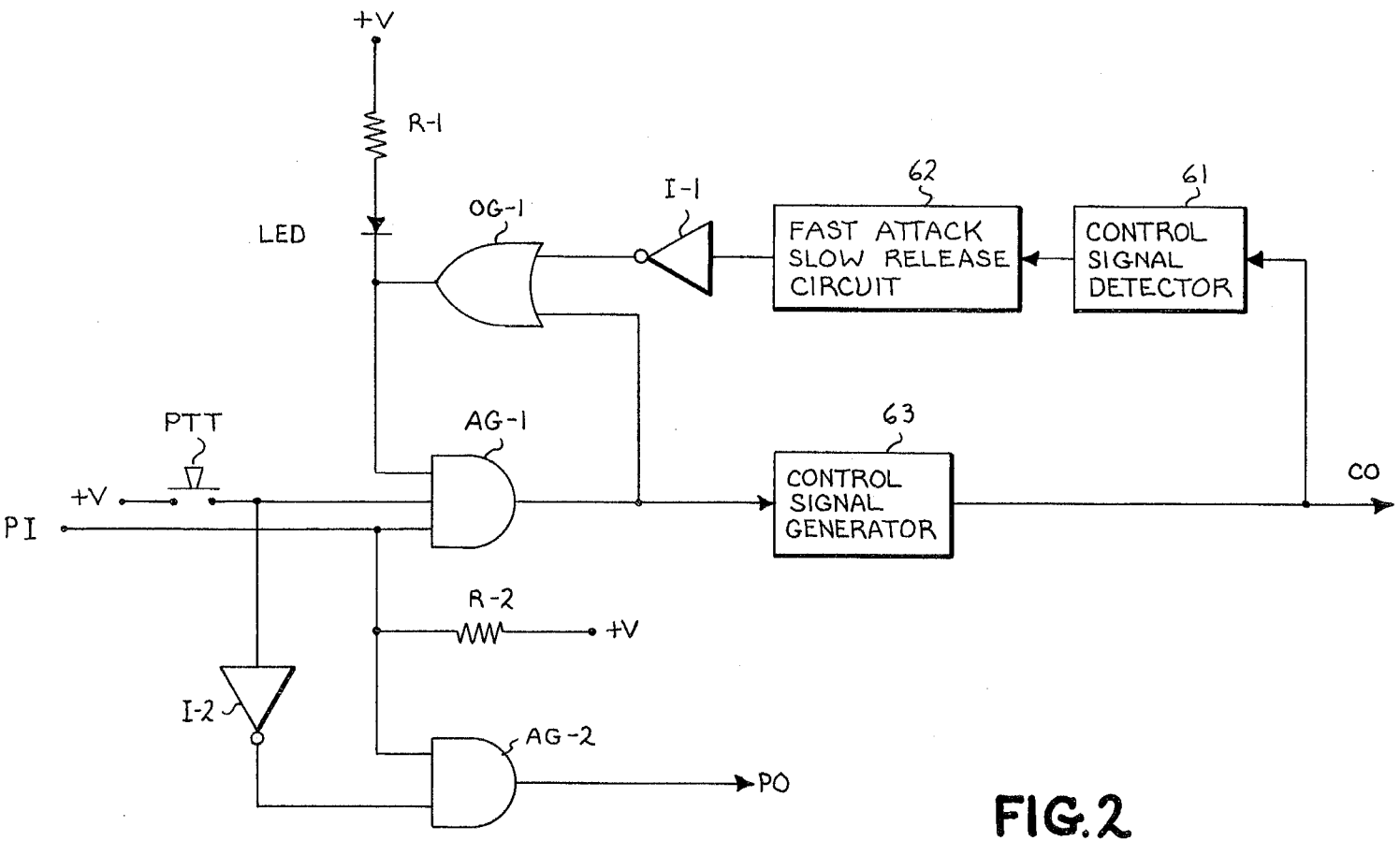
FIG. 2 shows a circuit diagram in accordance with my invention for each of the control locations in FIG. 1.

FIG. 2 shows a circuit, in accordance with my invention, to be provided at each of the control locations 10, 20, 30, 40. There is, for all practical purposes, no limit on the number of control locations which can be provided with and operated by my arrangement. In FIG. 2, I have provided circuits using positive logic conventions. However, persons skilled in the art will appreciate and understand that other types of logic and logic circuits may be used to provide the same functions. For these positive logic conventions, I have assumed that a logic 1 is +V volts, and a logic 0 is zero volts. At each control location, I provide a control signal detector 61 which senses tone (or whatever control signal is used) on any of the control outputs CO, and produces a logic 1 in response to a sensed tone, and a logic 0 in the absence of a sensed tone. The output of the signal detector 61 is applied to a fast attack, slow release circuit 62 which produces a logic 1 with a relatively fast attack time (for example less than 0.1 millisecond) in response to a logic 1 input; and which produces a logic 0 with a relatively slow release time (for example a delay of 50 milliseconds) in response to removal of the logic 1 input. The output of the circuit 62 is applied to a logic inverter I-1. Thus if tone is supplied to the control output CO, the inverter I-1 produces a logic 0 rapidly; and if tone is removed from the output CO, the inverter I-1 produces a logic 1 after a delay. I also provide a control signal generator 63 which produces the desired control signal at the output CO in response to a logic 1 applied to its input. The generator 63 may also produce different control signals in response to a logic 1 on its input if other logic inputs are provided.

If one control function to be provided is to key or turn-on a radio transmitter, this may be accomplished by operating a push-to-talk button PTT. When this button PTT is operated, it supplies a source of positive voltage +V (or logic 1) to the second input of an AND gate AG-1. The output of the AND gate AG-1 is applied to the input of the signal generator 63, and also to one input of an OR gate OG-1. The output of the inverter I-1 is applied to the other input of the OR gate OG-1. A source of positive voltage +V is applied through a resistor R-1 and a light emitting diode LED to the output of the OR gate OG-1. The output of the OR gate OG-1 is applied to the first input of the AND gate AG-1. The third input of the AND gate AG-1 is connected through a resistor R-2 to a source of positive voltage +V so that in the absence of a logic 0 on the priority input PI, this third input to the AND gate AG-1 is at a logic 1.

The operation of the circuit of FIG. 2, as described thus far, in each of the control locations 10, 20, 30, 40 of FIG. 1 will be explained in connection with the wave forms of FIG. 3 which are plotted along a common time axis. From top to bottom, these wave forms show: Presence and absence of tone (or control signal) from any source on the connected outputs CO; operated and released conditions of the push-to-talk button PTT; the output of the inverter I-1 showing the presence and absence of tone at the outputs CO; the output of the AND gate AG-1; and the output of the OR gate OG-1.

At the time T0, I have assumed that tone is present at the output CO from one of the other control locations. This is shown by a logic 1 for the output CO. Accordingly, the inverter I-1 produces a logic 0 indicating presence of tone. The AND gate AG-1 produces a logic 0 since the push-to-talk button PTT is not operated. Both inputs to the OR gate OG-1 are at a logic 0, so that the output of the OR gate OG-1 is a logic 0. This logic 0 permits current to flow from the voltage source +V through the resistor R-1 and the light emitting diode LED to indicate to an operator that tone from another control location is present. However, I prefer not to rely solely on this indication, but on the remainder of my circuit to be described. Thus, if the operator at a control location ignores the light emitting diode LED, he may still operate his push-to-talk button PTT as indicated at the time T1. However, this has no effect, because the OR gate OG-1 still produces a logic 0 that prevents the AND gate AG-1 from producing a logic 1. I have assumed that at the time T2, the tone present at the output CO from one of the other control locations is removed. After the indicated slow release or delay time provided by the circuit 62, the inverter I-1 produces a logic 1 at the time T3 indicating that no tone is present. This logic 1 causes the OR gate OG-1 to produce a logic 1 at the time T4. At this time, all of the inputs to the AND gate AG-1 are at a logic 1 and this gate AG-1 produces a logic 1 at the time T5. The logic 1 produced by the OR gate OG-1 at the time T4 also causes the light emitting diode LED-2 to be extinguished indicating that other units are no longer controlling the common equipment.

With the AND gate AG-1 producing a logic 1, the signal generator 63 produces the desired control signal or tone to the output CO at the time T6. This control signal or tone causes the controlled equipment 50 to perform the desired function. It should be noted that the time scale shown in FIG. 3 has been greatly expanded between the times T3 and T6 and between T7 and T9 in order to clearly indicate the sequence of events. These intervals are caused by the gate delay inherent in practical logic circuits and would be on the order of a few microseconds or less.

Figure 3:
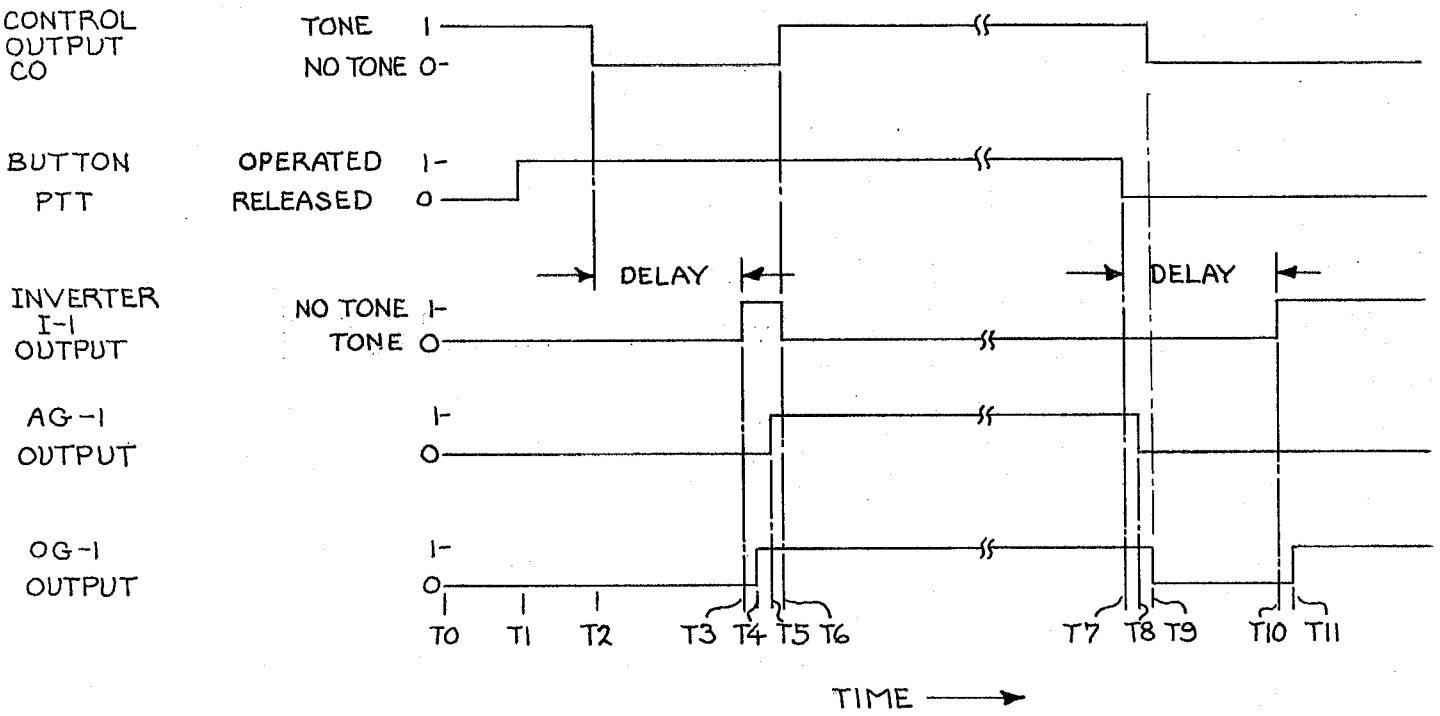
FIG. 3 shows wave forms for illustrating the operation of the arrangement of FIG. 2.

It should also be noted that in the sequence of events shown in FIG. 3, the interval between T1 and T6 represents the response time of the control circuits to the operator initiated action shown as PTT. If the operator had operated PTT at a later time, in particular a time later than T4, he would have experienced a response time interval (from PTT to the activation of the control signal) equivalent to the interval from T5 to T6. As noted this interval would be a few microseconds or less.

If he had operated the button PTT at a time between T2 and T4, he would experience only that portion of the delay which remained to expire, thus the response time is optimized.

Returning to the sequence as shown in FIG. 3, presence of the tone on the output CO causes the signal detector 61 to produce a logic 1, and the fast attack time of the circuit 62 causes the inverter I-1 to produce a logic 0 a short time afterward at the time T6. However, the OR gate OG-1 continues to produce a logic 1 because the AND gate AG-1 is producing a logic 1 that is supplied through the OR gate OG-1 to hold the AND gate AG-1 in this condition. Thus, the tone produced by the generator 63 and detected by the detector 61 does not cut off the control signal generated at the location effecting control.

Nothing further happens until the operator releases the push-to-talk button PTT at the time T7. This removes the logic 1 from one of the inputs to the AND gate AG-1 to cause the AND gate AG-1 to produce a logic 0 at the time T8. The 0 at the output of AG-1 causes the signal generator 63 to remove the control signal from the output CO. Both inputs to the OR gate OG-1 are now at a logic 0 and it produces a logic 0 at the time T9 so that the AND gate AG-1 is again held in a logic 0 condition.

After the slow release or delayed time of the circuit 62, and assuming that there is no other tone present on the outputs CO, the inverter I-1 produces a logic 1 again at the time T10. This logic 1 causes the OR gate OG-1 to produce a logic 1 at the time T11, extinguishing the light emitting diode LED, and again placing the AND gate AG-1 in condition for operation in response to the push-to-talk button PTT. The circuit is back in condition for either permitting another control location to provide a control signal or tone, or for permitting the same control location to provide another signal or tone. Thus, my circuit provides an arrangement which permits only one control location of a plurality to provide a control signal or tone at any one time, and introduces reset delay only to the extent required. This insures that proper control of the remote controlled equipment is always provided without interference or improper operation.

In some situations where there are a plurality of control locations as shown in FIG. 1, it is frequently desirable that each of the control locations be given a priority of control with respect to the other locations. In the example of FIG. 1, control location 10 has first priority, control locations 20, 30 have second and equal priority, and control location 40 has third priority.

At each of the control locations 10, 20, 30, 40, the priority circuit includes an AND gate AG-2 having one input connected through a logic inverter I-2 to the button PTT. The priority input PI is connected to the other input of the AND gate AG-2, and to the third input of the AND gate AG-1. The priority output PO is derived from the AND gate AG-2. Since a priority output PO may be connected to another priority output PO or to a priority input PI as shown in FIG. 1, I prefer that the AND gate AG-2 of each circuit should be of the open collector (or comparable) type so that a plurality of such gates may be interconnected to perform a wired-AND function. This eliminates the need for another AND gate where two or more priority outputs PO are connected in parallel.

The operation of the priority control will be explained for the condition of FIG. 1 where location 10 has first priority, locations 20, 30 have second and equal priority, and location 40 has third priority. Initially, I have assumed that first priority location 10 is performing a control function. This produces a logic 0 at its priority output PO that causes each of the AND gates AG-2 at locations 20, 30 to produce a logic 0. The AND gates AG-2 at locations 20, 30 produce logic 0's which are applied to the AND gate AG-1 in the control location 40 to prevent location 40 from producing a control signal. With respect to the control locations 20, 30, the logic 0 from location 10 is applied to the AND gates AG-1 in locations 20, 30 to prevent locations 20, 30 from producing a control signal.

Once the control location 10 stops production of a tone by releasing the button PTT, the priority output PO returns to a logic 1. If, at the lower priority locations 20, 30 the buttons PTT are not depressed, the logic inverters I-2 produce logic 1's. Both inputs to the AND gates AG-2 are at logic 1, so these AND gates AG-2 produce logic 1's which permit lower priority location 40 to be operative. If the operator at control location 20 now wishes to perform a function, he would operate the push-to-talk button PTT. This would permit the AND gate AG-1 to produce a logic 1 and operate the signal generator 63. The logic 1 provided by the push-to-talk button PTT is also applied to the logic inverter I-2 to provide a logic 0 at the input to the AND gate AG-2. The AND gate AG-2 produces a logic 0 at the priority output to prevent all lower priority locations from producing a control function. While this logic 0 at the priority output would not prevent the control location 30 (which has equal priority with the location 20) from producing a control function, the control signal produced at the output CO of location 20 would prevent location 30 from producing a control function as described earlier in connection with FIG. 3. If the locations utilizing my invention are such that equal priority locations may cause confusion, then a clear order of priority should be established with no location having the same priority as any other location.

If the locations 10, 20, 30 are to have first, second, third, and fourth priorities with respect to each other, the output PO of location 10 would be connected to input PI of location 20; the output PO of location 20 would be connected to input PI of location 30; and the output PO of location 30 would be connected to input PI of location 40. Persons skilled in the art will appreciate and understand how the example of four locations shown in FIG. 1 can be expanded to provide any combination of priorities for almost any plurality of locations using my versatile circuit of FIG. 2.

It will thus be seen that I have provided a new and improved arrangement for use in controlling remote controlled equipment from a plurality of different control locations without interference, and for establishing priority between those locations. While I have shown only one embodiment of my invention, persons skilled in the art will appreciate the many modifications that may be made. For example, various types of logic circuits and logic voltages may be utilized in place of the particular ones shown and described, and still perform the indicated function or operation. Likewise, any number of locations may be utilized and still come within the scope of my invention. The functions of the signal detector 61, the circuit 62, and the inverter I-1 can be combined into a single arrangement. Also, the light emitting diodes LED may be omitted. Therefore, while my invention has been described with reference to a particular embodiment, it is to be understood that modifications may be made without departing from the spirit of the invention or from the scope of the claims.

What I claim as new and desire to secure by Letters Patent of the United States is:

1. In a system having common equipment and a plurality of control locations for controlling said common equipment, an arrangement for use at each of said control locations to prevent more than one of said control locations from producing a control signal at the same time and to provide optimum control of the interval between control signals comprising:

a. a control output terminal for connecting said control location to said common equipment;

b. a control signal generator having an input for rendering said signal generator operative and producing a control signal in response to a logic 1 signal, and having an output connected to said control output terminal;

c. a signal detector having an input connected to said control output terminal; and having an output for producing a logic 0 in response to the presence of a control signal at said control output terminal, and for producing a logic 1 following a predetermined time delay after and in response to the absence of a control signal at said control output terminal;

d. an OR gate having first and second inputs and an output;

e. a first AND gate having first and second inputs and an output;

f. means connecting said OR gate first input to said signal detector output;

g. means connecting said OR gate output to said first AND gate first input;

h. means connecting said first AND gate output to said OR gate second input and to said signal generator input;

i. and means connected to said first AND gate second input for selectively applying a logic 1 thereto to render said signal generator operative in the absence of a control signal at said control output terminal.

2. The arrangement of claim 1, and further comprising:

j. said first AND gate having a third input;

k. a priority input terminal for connection to a higher priority location and a priority output terminal for connection to a lower priority location;

l. a second AND gate having first and second inputs and an output;

m. logic inversion means connecting said second AND gate first input to said selective applying means;

n. means connecting said priority input terminal to said first AND gate third input and to said second AND gate second input;

o. and means connecting said second AND gate output to said priority output terminal.

3. In a system having common equipment to be controlled and a plurality of control locations for controlling said common equipment, an arrangement for use at each of said control locations to prevent more than one of said control locations from producing a control signal at the same time and to provide optimum control of the interval between control signals comprising:

a. a control output terminal for connecting said control location to said common equipment;

b. a control signal generator having an input for rendering said signal generator operative and producing a control signal in response to a first logic signal applied to said input; and having an output connected to said control output terminal;

c. a signal detector having an input connected to said control output terminal and having an output for producing, after a predetermined time delay, said first logic signal in response to the absence of a control signal at said control output terminal; and for producing a second logic signal in response to the presence of a control signal at said control output terminal;

d. first logic means having a plurality of inputs and an output for producing said first logic signal in response to any one of said inputs having said first logic signal thereat, and for producing said second logic signal in response to all of said inputs having said second logic signals thereat;

e. second logic means having a plurality of inputs and an output for producing said first logic signal in response to all of said inputs having said first logic signals thereat, and for producing said second logic signal in response to any one of said inputs having said second logic signal thereat;

f. means connecting a first input of said first logic means to said signal detector output;

g. means connecting said output of said first logic means to a first input of said second logic means;

h. means connecting said output of said second logic means to a second input of said first logic means and to said signal generator input;

i. and means connected to a second input of said second logic means for selectively applying said first logic signal thereto to render said signal generator operative in the absence of a control signal at said control output terminal.

4. The arrangement of claim 3, and further comprising:

j. a priority input terminal for connection to a higher priority location and a priority output terminal for connection to a lower priority location;

k. third logic means having a plurality of inputs and an output for producing said first logic signal in response to all of said inputs having said first logic signals thereat, and for producing said second logic signal in response to any one of said inputs having said second logic signal thereat;

l. logic inversion means connecting a first input of said third logic means to said selective applying means;

m. means connecting said priority input terminal to a third input of said second logic means and to a second input of said third logic means;

n. and means connecting said output of said third logic means to said priority output terminal.

5. The arrangement of claim 3 or claim 4 and further comprising indicating means connected to said output of said first logic means for providing an indication in response to said second logic signal thereat.

6. In a system having common equipment to be controlled and having a plurality of control locations for controlling said common equipment, an arrangement for use at each of said control locations to prevent more than one of said control locations from producing a control signal at the same time and to provide optimum control of the interval between control signals comprising:

a. a control output terminal for connecting said control location to said common equipment;

b. a control signal generator having an activate signal input for rendering said signal generator operative to produce a control signal at an output in response to an activate signal at said input, said generator output being connected to said control output terminal;

c. a signal detector having an input connected to said control output terminal; and having an output for producing an activate signal after a predetermined time delay in response to the absence of a detected signal at said control outut common terminal, and for producing a deactivate signal in response to the presence of a detected signal at said control output terminal;

d. selectively operable means for producing said activate signal;

e. and first logic means interconnecting said signal detector output, said selectively operable means, and said signal generator input for applying said activate signal from said selectively operable means to said signal generator input in response to an activate signal from said signal detector, and for blocking said activate signal from said selectively operable means in response to the presence of a deactivate signal from said signal detector before said selectively operable means are operated.

7. The arrangement of claim 6, and further comprising:

f. a priority input terminal for connection to a higher priority location and a priority output terminal for connection to a lower priority location;

g. and second logic means connected to said first logic means and interconnecting said priority input terminal and said priority output terminal for causing said first logic means to block said activate signal in response to a priority signal at said priority input terminal, and for applying said priority input signal to said priority output terminal; and for permitting said activate signal to be applied in response to the absence of a priority signal at said priority input terminal, and for applying a priority signal to said priority output terminal in response to an activate signal from said selectively operable means.

* * * * *